US006918733B2

(12) United States Patent
Neuber et al.

(10) Patent No.: US 6,918,733 B2
(45) Date of Patent: Jul. 19, 2005

(54) HOLD DOWN CLAMP FOR HOLDING DOWN SHEET MATERIAL

(75) Inventors: Ingo Neuber, Tuettendorf (DE); Dirk Dobrindt, Klausdorf/Schwentine (DE)

(73) Assignee: Eastman Kodak Company, Rochester, NY (US)

( * ) Notice: Subject to any disclaimer, the term of this patent is extended or adjusted under 35 U.S.C. 154(b) by 148 days.

(21) Appl. No.: 10/277,347

(22) Filed: Oct. 22, 2002

(65) Prior Publication Data

US 2003/0090054 A1 May 15, 2003

(30) Foreign Application Priority Data

Nov. 9, 2001 (DE) ..... 101 55 052

(51) Int. Cl.[7] ..... B65G 7/00

(52) U.S. Cl. ..... 414/426; 271/220; 271/223; 271/224; 280/47.27; 280/47.28; 280/47.29

(58) Field of Search ..... 271/207, 220, 271/213, 223, 224; 414/907, 426, 751.1; 280/47.27, 47.28, 47.29; 269/55

(56) References Cited

U.S. PATENT DOCUMENTS

| | | | | | |
|---|---|---|---|---|---|
| 429,140 | A | * | 6/1890 | Mallory | 414/449 |
| 455,653 | A | * | 7/1891 | Butcher | 414/456 |
| 2,795,433 | A | * | 6/1957 | Moriarty | 280/47.28 |
| 3,112,042 | A | * | 11/1963 | Leshner | 414/490 |
| 3,278,061 | A | * | 10/1966 | Christensen | 414/456 |
| 3,413,668 | A | | 12/1968 | Bak et al. | 11/1 |
| 3,741,413 | A | * | 6/1973 | Friel | 414/395 |
| 3,805,971 | A | | 4/1974 | Behrens et al. | 214/6 |
| 3,825,134 | A | * | 7/1974 | Stobb | 414/802 |
| 3,986,614 | A | * | 10/1976 | Fernandez-Rana et al. | 211/51 |
| 4,577,853 | A | * | 3/1986 | Duke | 271/217 |
| 4,659,072 | A | * | 4/1987 | De La Rosa | 269/17 |
| 4,861,227 | A | * | 8/1989 | Cinotti | 414/796.8 |
| 4,880,350 | A | * | 11/1989 | Stobb | 414/790.2 |
| 4,893,824 | A | * | 1/1990 | Turek et al. | 280/47.27 |
| 5,102,154 | A | * | 4/1992 | McDonald | 280/47.27 |
| 5,299,659 | A | * | 4/1994 | Imbeault et al. | 414/592 |
| 5,322,496 | A | * | 6/1994 | Ernst et al. | 493/410 |
| 5,439,209 | A | * | 8/1995 | Runzi | 271/251 |
| 5,647,720 | A | * | 7/1997 | Golicz et al. | 414/490 |
| 5,676,367 | A | | 10/1997 | Oshino et al. | 271/212 |
| 5,927,731 | A | * | 7/1999 | Clarke | 280/79.7 |
| 5,971,691 | A | * | 10/1999 | Munson et al. | 414/398 |
| 6,059,515 | A | * | 5/2000 | Keller et al. | 414/721 |
| 6,135,466 | A | * | 10/2000 | Irwin | 280/47.28 |
| 6,293,568 | B1 | * | 9/2001 | Butterfield et al. | 280/33.995 |
| 6,312,208 | B1 | * | 11/2001 | Crowley et al. | 414/398 |
| 6,505,842 | B2 | * | 1/2003 | Butterfield et al. | 280/33.995 |
| 6,540,242 | B1 | * | 4/2003 | Raichlen | 280/47.27 |
| 6,626,631 | B1 | * | 9/2003 | Malakiman | 414/773 |
| 6,702,278 | B1 | * | 3/2004 | Michel | 271/220 |
| 6,736,584 | B2 | * | 5/2004 | Dehn et al. | 414/396 |
| 2003/0184011 | A1 | * | 10/2003 | Schaareman et al. | 271/207 |

FOREIGN PATENT DOCUMENTS

| | | |
|---|---|---|
| DE | 283660 | 4/1995 |

* cited by examiner

*Primary Examiner*—Donald P. Walsh
*Assistant Examiner*—Matthew J Kohner
(74) *Attorney, Agent, or Firm*—Lawrence P. Kessler

(57) ABSTRACT

A hold down clamp for holding down a stack of sheet material, preferably on a transportation trolley selectively in operative association with a printing machine. The hold down clamp has a vertically adjustable holding arm selectively lockable along a substantially upright guide member. The holding arm has at least one release member for releasing locking, the release member being movable in the direction away from the stack. This allows the holding arm to be pliable upwardly in case of emergency.

13 Claims, 3 Drawing Sheets

HOLD DOWN CLAMP FOR HOLDING DOWN SHEET MATERIAL

FIELD OF THE INVENTION

The invention relates to a hold down clamp for holding down a stack of sheet material, more specifically paper, on a transportation trolley, for a sheet stack for selective operative association with a printing machine.

BACKGROUND OF THE INVENTION

A hold down clamp of the above-described type is known from U.S. Pat. No. 5,676,367. The above described hold-down clamp has the primary function to hold down a stack being formed by applying a certain pressure before the stack grows big enough to hold by its own weight, whereafter the hold down clamp can be removed, which takes place automatically with a predetermined stack height.

More specifically, when the hold down clamp is used for a stack transfer from the delivery device of a printing machine to a transportation trolley or from the transportation trolley to the paper feeder of the printing machine, it can, as a result of a malfunction, cause a dangerous situation. The hold down clamp can present a danger of injury to operation personnel who can be crushed between the hold down clamp and the stack. Further, the transportation trolley can be subject to an overturning force through the protruding hold down clamp because of the relative movement between the stack and the hold down clamp, e.g., upon lifting the stack under the hold down clamp in excess of the clamp's vertical position.

SUMMARY OF THE INVENTION

The invention is based on the problem of providing a hold down clamp having at least one safety function, more specifically, in case of an unexpected upward force application.

This problem is solved according to the invention by the fact that the hold down arm has at least one release member, which is movable in the direction away from the stack, for releasing its locked condition.

As mentioned above, an especially dangerous situation occurs when the stack moves up, and there is a danger that an operator can have his/her hand crushed between the stack and the hold down clamp, or the stack can uplift and overturn the entire structure such as a transportation trolley, which is provided with the hold down clamp, through the hold down clamp. Since the hold down clamp locking to its guide member is released with the help of at least one release member, the hold down clamp can move up in the former case. The hold down clamp can be provided with various release members for different loads, and/or a multiple-stage release member can be provided, and, in addition, and most preferably, one stage having a lower resistance than the other, e.g., elastic pliability of at least one area of the hold down clamp is assured. This is provided by a further development of the present invention by a contact member, through which the hold down clamp comes in contact with the stack, which is preferably made as a plunger extending downwardly from the release member.

The release of the release element generally can be assured electrically, e.g., by sensors, but, according to the invention, it is preferred that a mechanical release be provided, which can likewise reliably react to a mechanical effort and which does not depend in an emergency situation on electrical devices that can malfunction.

The above-described contact member can be coupled to a release member in such a manner that first pliability stroke and then release are ensured, thus assuring a two-stage action, which applies only a light single load on the hold down clamp locking. A plunger of a key switch type can be used, with pliability in the direction toward the release member. The pliability can also have two stages of different resistance, and the harder stage is the second stage, which causes release of the release member. The first stage can be provided, e.g. by a force of resistance of a leaf spring.

According to another embodiment of the invention, the release member extends substantially over the entire length of a holding arm because the danger of crushing exists not only in the immediate vicinity of the contact member, and the release is also required in other areas of the holding arm.

For release, the release member can be rotatable about at least a horizontal axis running transversally to the release member position, and since force can be applied in different directions different axes can be used, the release member can be made, e.g., as a double-arm lever or a single-arm lever. The release member can itself be under the action of an elastic resistance force.

A simple, durable, reliable, maintenance-free, and steplessly vertically adjustable, with releasable locking, of the holding arm is provided in another embodiment of the invention by the fact that the holding arm is lockable by a perforated clamping plate, which is put with a mating cross-section on a rod-shaped guide member and which can be positioned at an angle with a slight inclination on the guide member, thus assuring the locking. The locking is released by simply inclining the clamp plate further, and the load acting in the inclination direction has an accurately adjustable and pre-selectable threshold value to rule out inadvertent release.

In another embodiment of the invention, the holding arm can be turned in the horizontal plane as a whole in one vertical position about the guide member or about another axis from its working position, e.g., through 90° from the stack area, e.g., in such a manner as not to interfere with the removal, placement, or growth of the stack, or simply to a transportation position as a space saver measure, for instance, when a limited space is available for the whole unit such as the transportation trolley.

The invention, and its objects and advantages, will become more apparent in the detailed description of the preferred embodiment presented below.

BRIEF DESCRIPTION OF THE DRAWINGS

In the detailed description of the preferred embodiment of the invention presented below, reference is made to the accompanying drawings, in which.

DETAILED DESCRIPTION OF THE INVENTION

Figure 1:
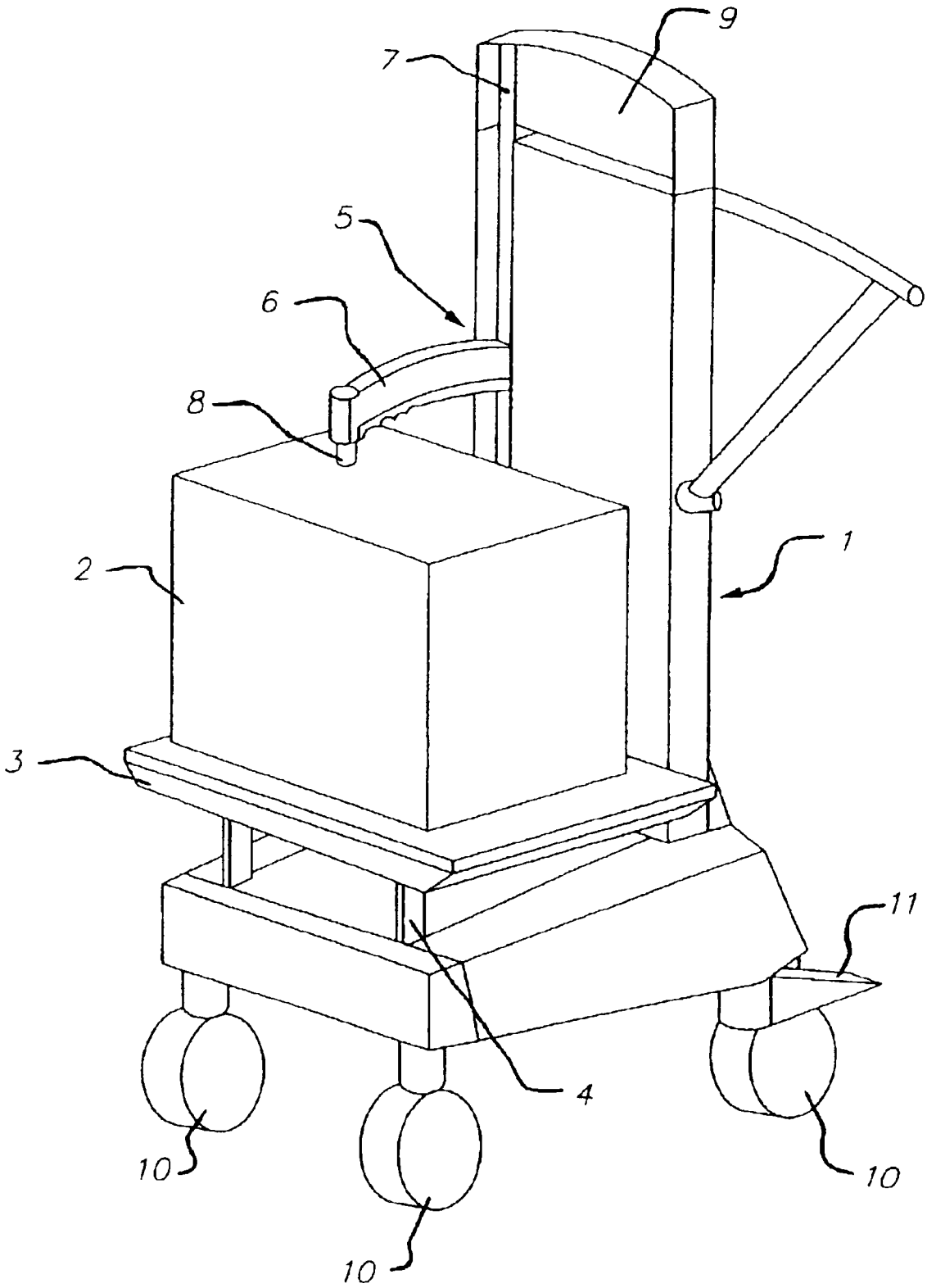
FIG. 1 shows a paper transportation trolley in a schematic perspective view, having a hold down clamp according to the invention.

Referring now to accompanying drawings:

FIG. 1 shows a schematic perspective view of a sheet material stack transportation trolley 1. A stack 2 of sheet material, particularly paper sheets, is loaded on the transportation trolley 1. The stack 2 is loaded on a pallet 3, which is supported by a load-bearing part 4 of the paper transportation trolley.

The stack 2 is held from top, especially when the paper transportation trolley 1 is moving, by a hold down clamp 5 according to the invention, which has a holding arm 6 vertically adjustable and lockable on a guide rod 7. To hold the stack 2, the holding arm 6 contacts with the top sheet of the stack 2 through a plunger-like contact member 8, which is provided in the area of the distal end of the holding arm 6 and protrudes downwardly from the holding arm 6. In the top position, the holding arm 6 can be turned about the guide rod 7 in the horizontal plane substantially through 90° into a parking position in a recess 9.

In general, the paper transportation trolley 1 has castors 10 for movement and at least one castor which can be locked with a brake 11.

Figure 2:
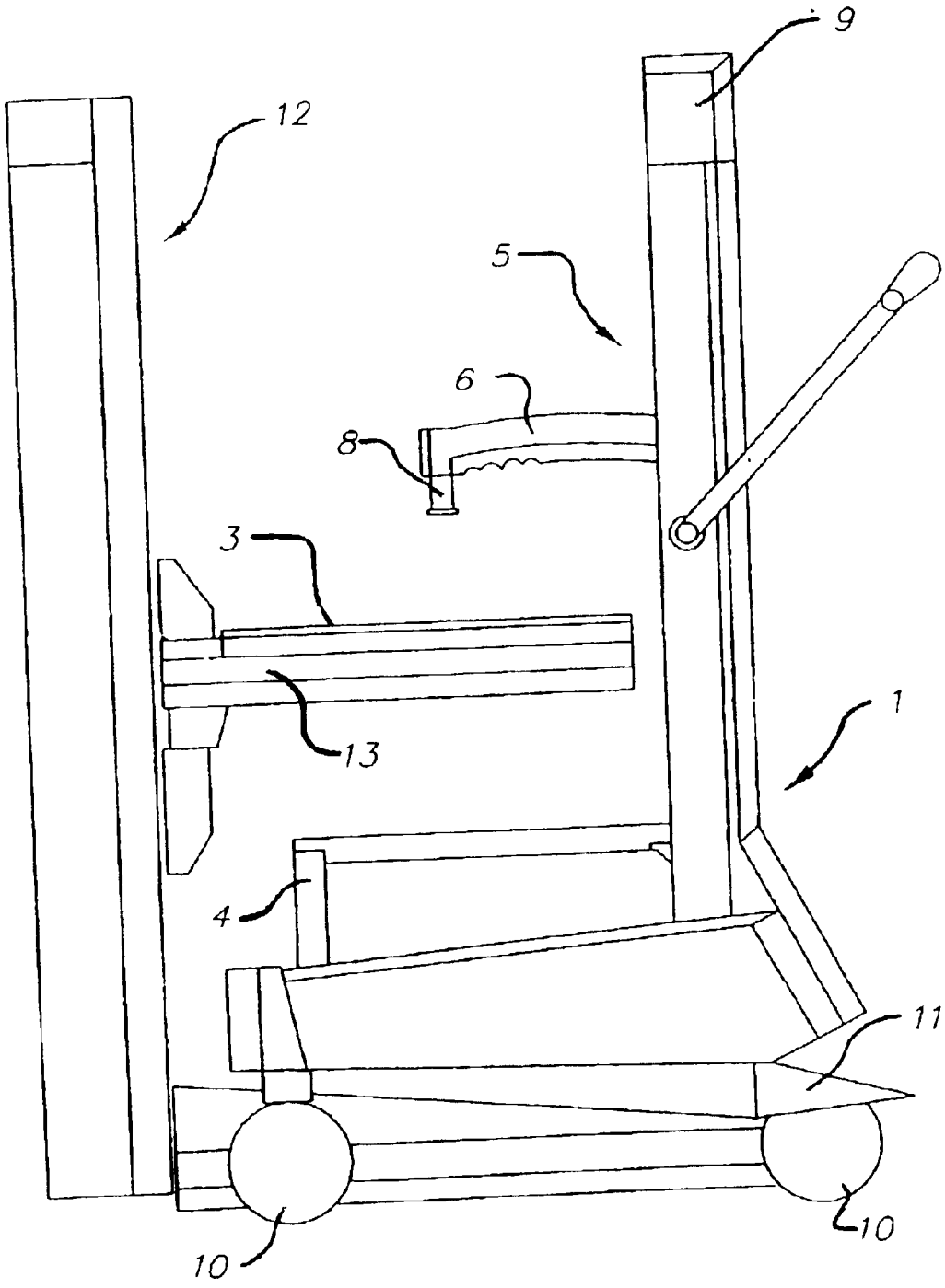
FIG. 2 is a schematic side elevation view of the paper transportation trolley of FIG. 1 as used with a paper lift table of the delivery device of a printing machine.

FIG. 2 shows in a schematic side elevation view a joint application example of the paper transportation trolley 1 of FIG. 1 and a paper elevator 12 with a paper lift table 13, which is used to lift and lower the pallet 3. In this specific example, the paper transportation trolley 1 is docked to the paper elevator 12, which, in turn, can be provided on the delivery device of a printing machine.

The joint use of the paper lift table 13 and the paper transportation trolley 1 can cause a specific danger, which will be described with reference to FIG. 2.

The paper transportation trolley 1 is selectively used to remove finished printed folded sheets from the delivery device of a printing machine with the help of the paper elevator 12 and to transport them to a destination. In printing, each folded sheet may have a different thickness over its surface, especially when it is printed by the electrophotographic method with application of a single toner layer or multiple toner layers. The stack 2 of the folded printed sheets is, therefore, rather unstable compared to a stack of non-printed sheets. It should be noted that a hold down clamp 5 according to the invention is required for the transportation of the stack 2 on the paper transportation trolley 1 in order to secure and to hold the stack 2 in register, for example on the pallet 3.

When the stack 2 is transferred from the elevator 12 to the paper transportation trolley 1, the stack, which is located on the pallet 3, is lowered down with the pallet by the paper lift table 13 and is placed on the support structure 4 of the paper transportation trolley 1. As can be seen in FIG. 2, the pallet 3 is shown empty, without the stack 2, for the sake of clarity. When the stack 2 is transferred, the holding arm 6 of the hold down clamp 5 of the paper transportation trolley 1 is in the state of readiness out of its parking position in the recess 9, but it is in such vertical position that before the stack 2 is brought into the area of the paper transportation trolley 1 over the support structure 4, it does not interfere. Later on, when the pallet 3 with the stack 2 has been lowered down on the support structure 4, the holding arm 6 is lowered down until its contact member 8 rests against the stack 2 with a desired pressure, and the stack is held together and secured, more specifically when the paper lift table 13 leaves the area of the paper transportation trolley 1 when the paper transportation trolley 1 is released from the paper elevator 12, and the stack 2 is delivered or released by the paper elevator.

During the relative movement between the holding arm 6 and the paper lift table 13, there might be a danger of either the lowering down of the holding arm 6 or the lifting of the paper lift table 13 in error and unexpectedly, e.g., as a result of a malfunction of the control system.

At that moment, the operator can have, e.g., his/her hand crushed between the stack 2 and the holding arm 6, more specifically under the contact member 8 or in another area of the holding arm 6. It is even possible for the paper lift table 13 to be lifted to such an extent that it can uplift and overturn the entire paper transportation trolley 1 with the holding arm 6. The safety functions of the hold down clamp 5 according to the invention in case of such dangerous situations will be described below with reference to FIG. 3.

Figure 3:
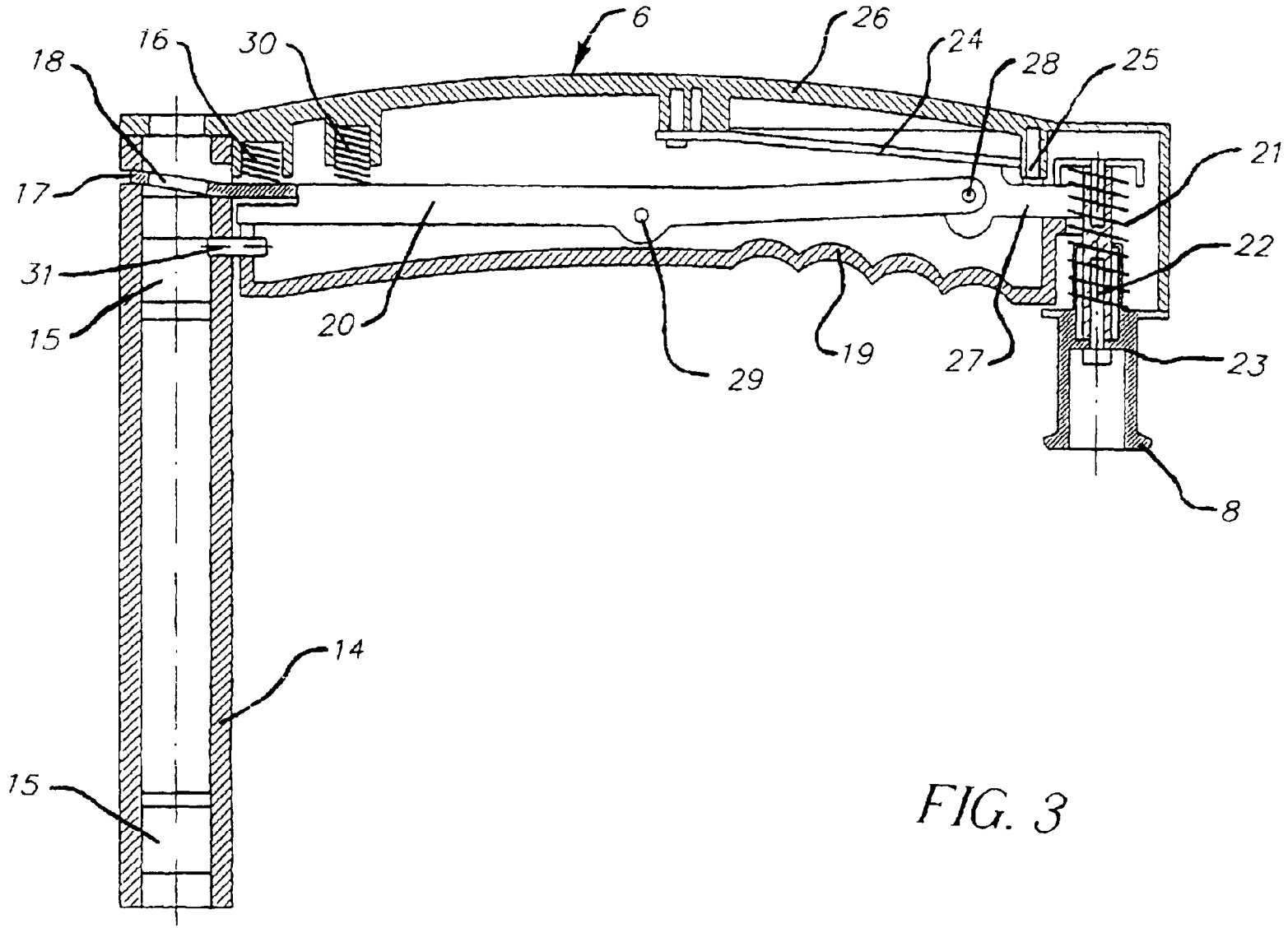
FIG. 3 is a sectional view of a holder arm of the hold down clamp of FIGS. 1 and 2.

FIG. 3 shows a sectional view of the whole assembly of the holding arm 6.

The holding arm 6 has a guide sleeve 14, which is coaxially guided on the guide rod 7 and which has integrally made guide bushings 15. A bent perforated clamping plate 17 having a hole 18, which is biased by a clamp spring 16, can lock the holding arm 6 steplessly on the guide rod 7 by inclining the clamping plate 17 on the guide rod 7. With the help of an elongated release member 19, the clamping plate 17 can be moved up by a transmission lever 20, overcoming the pressure of the clamping spring 16 so the locking function is released.

The contact element 8 is made as a plunger, which is elastically pliable under the action of a plunger spring 21 on a central guide member 22 and against a stop 23. Under the pressure of a leaf spring 24, which engages a stop 25 and is attached to a body 26 of the holding arm 6, the contact member 8 in its path of movement finally engages a driver member 27 of the transmission lever 20, and the locking of the clamping plate 17 is released. The stack 2 is also put under pressure through the plunger-like contact member 8. The clamping of the clamping plate 17 keeps the holding arm 6 locked to the guide rod 7. When the release member 19 is lifted, the clamping is released, and the holding arm 6 can be moved with a light force application farther up along the guide rod 7.

The release member 19 covers almost the entire bottom area of the body 26 of the holding arm 6. If the operator puts his/her body part between the stack 2 or empty pallet 3 and the holding arm 6 during the upward movement of the paper lift table, the release member 19 will be lifted, and the locking of the holding arm 6 will be released.

If an upwardly directed force is applied to the plunger-like contact member 8, the contact member 8 is retracted along its guide member 22, by moving up. If the operator puts a body part under the contact member, the contact member comes to press against the spring 21. In this case, the operator has a response time and opportunity to move the body part off the dangerous zone.

When a force applied to the holding arm 6 exceeds a threshold limit, the locking of the holding arm is released. This force is adjusted in such a manner that the paper lift table 13 entrains the holding arm 6 in its movement without uplifting the paper transportation trolley 1.

The two guide bushings 15 support the holding arm on the guide rod 7, which is attached to the paper transportation trolley 1. The clamping plate 17 is loaded by the clamping spring 16 in such a manner that the clamping prevents the lifting of the holding arm 6 that is thus locked. If the clamping plate 17 is lifted by the transmission lever 20, the clamping is released, and the holding arm 6 can be moved along the guide rod 7.

The transmission lever 20 is mounted in the body 26 on a pivot pin 28. The release member 19 is connected to the transmission lever 20 by a pivot pin 29. A return spring 30 presses the transmission lever 20 and the release member 19 against a stop pin 31. When the operator lifts the release member 19 and the transmission lever 20 in the zone of the stop pin 31, the release member 19 and the transmission lever 20 turn about the pivot pin 28 of the transmission lever 20. The clamping plate 17 is then moved up, and the locking is released.

When the operator lifts the release member 19 in the zone of the plunger-like contact member 8, the release member 19 turns up about its support stop pin 31. The transmission lever 20 is lifted through the pivot pin 29 of the release member 19, and it turns up about its pivot pin 28. The clamping plate 17 is then moved up, and the locking is released.

Should the plunger-like contact member 8 move up, the light spring 21 is first compressed. The contact member 8 can move along the guide member 22 along a path of such a length that the operator has enough time to move a body part off the dangerous zone. If the contact member 8 has moved in excess of this path, it will release tension of the leaf spring 24. The tension of the leaf spring corresponds to the force by which the stack 2 should be pressed. When this force is overcome, the leaf spring 24 gives in. At this point, the contact member 8 entrains the release member 19, and locking by the clamping plate 17 is released in the manner described above.

If the operator presses against the stack 2 with an excessive force, the locking is released, and the holding arm 6 moves up until the force at the contact member 8 is within the admissible range.

The invention has been described in detail with particular reference to a preferred embodiment thereof, but it will be understood that variations and modifications can be effected within the spirit and scope of the invention.

What is claimed is:

1. A hold down clamp for a stack of a sheet material carried on a transportation trolley for selective operative association with a printing machine, comprising: a holding arm (6) adjustable along an upright guide member (7), said holding arm extending substantially horizontally at its distal end and having, in the area of its distal end, a contact member (8) mounted for lowering down on the top sheet of the sheet material, said contact member (8) at least partly elastically pliable under the return force on engagement with the stack (2), said holding arm including a locking device (17) so as to be selectively lockable to, and releasable from, said upright guide member (7), said holding arm (6) having at least one release member (19) operatively associated with said locking device (17), said at least one release member (19) being movable in the direction parallel to said guide member away from the stack (2), for moving said locking device relative to said guide member to release said locking device from said guide member.

2. The hold down clamp of claim 1, wherein said contact member (8) is made as plunger facing toward the stack (2).

3. The hold down clamp of claim 2, wherein said plunger extends downwardly beyond said release member (19).

4. The hold down clamp of claim 3, wherein said release member (19) is a mechanically acting member.

5. The hold down clamp of claim 4, wherein said plunger is made for engagement with said release member (19) in the elastic pliability direction.

6. The hold down clamp of claim 5, wherein the elastic pliability of said contact member (8) is two-staged and offers more resistance at the second stage than at the first stage, the greater resistance being provided for coupling with said release member (19).

7. The hold down clamp of claim 6, wherein the first stage of said two-staged pliability of the return force is taken up by a helical spring (21), and the second stage of said two-staged pliability of the return force is taken up by a leaf spring (24).

8. The hold down clamp of claim 4, wherein said release member (19) extends for release substantially over the entire length of said holding arm (6).

9. The hold down clamp of claim 8, wherein said release member (19) is rotatable about at least one axis (29) extending horizontally and transversally with respect to said holding arm (6).

10. The hold down clamp of claim 4, wherein said release member (19) is exposed to a return force.

11. The hold down clamp of claim 1, wherein locking device (17) of said holding arm (6) includes a perforated clamping plate, which is guided in an inclined position along a substantially rod-shaped guide member (7).

12. The hold down clamp of claim 11, wherein said perforated clamping plate is exposed to a return force in the vertical direction.

13. The hold down clamp of claim 12, wherein said holding arm (6) can be turned about said guide member (7) out of its working position in at least one vertical position.

* * * * *